United States Patent [19]

Broberg, Jr.

[11] 4,013,336

[45] Mar. 22, 1977

[54] CONNECTOR CLIP

[76] Inventor: Dewey O. Broberg, Jr., Rte. No. 1, P.O. Box 102, Long Grove, Ill. 60047

[22] Filed: Mar. 25, 1976

[21] Appl. No.: 670,436

[52] U.S. Cl. ..... 339/253 R

[51] Int. Cl.[2] ..... H01R 13/54

[58] Field of Search ..... 339/252, 253, 255, 256, 339/258, 262; 123/143 C, 145 A, 148 A; 317/98

[56] References Cited

UNITED STATES PATENTS

| | | | |
|---|---|---|---|
| 954,872 | 4/1910 | Mosler | 339/258 C |
| 3,038,971 | 6/1962 | Weymouth | 339/255 R |
| 3,829,826 | 8/1974 | Brown et al. | 339/255 R |

FOREIGN PATENTS OR APPLICATIONS

| | | | |
|---|---|---|---|
| 314,169 | 1/1934 | Italy | 339/255 R |

*Primary Examiner*—Joseph H. McGlynn
*Attorney, Agent, or Firm*—Hosier, Niro & Daleiden, Ltd.

[57] ABSTRACT

A connector clip for releasably attaching a source of electrical current to a miniature internal combustion engine is disclosed wherein the two contacting surfaces of the connector clip are held firmly to the engine itself by a force which causes one contact to move substantially parallel to the other. The contacting surface of the connector clip which engages the tip of the glow plug of the engine is provided with a recess to receive the glow plug tip. In this manner, both electrical reliability and safety operation are improved.

11 Claims, 5 Drawing Figures

FIG. 4
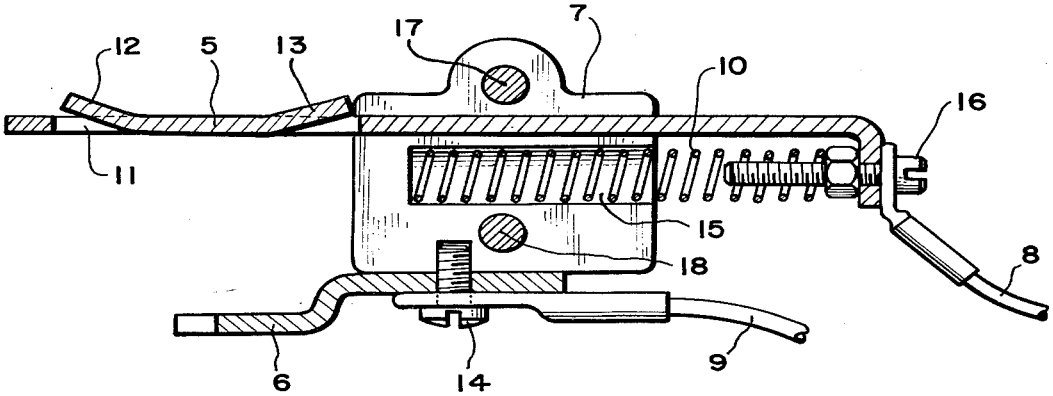
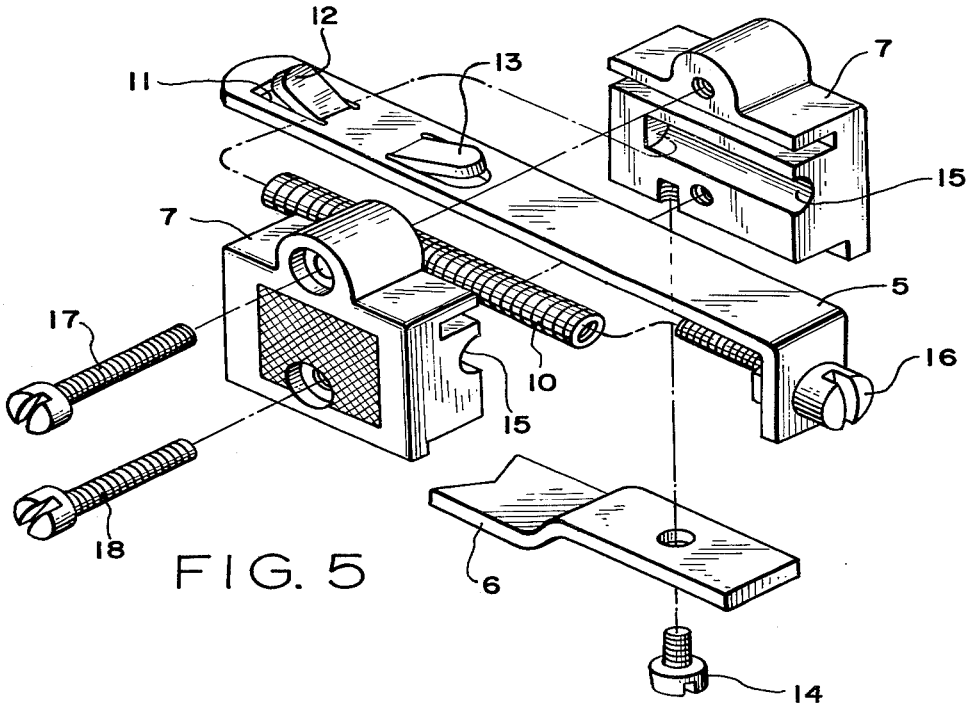
FIG. 5

CONNECTOR CLIP

BACKGROUND AND SUMMARY OF THE INVENTION

This invention concerns a connector clip and more particularly a dual conductor connector clip adapted for releasable attachment to and removal from a miniature internal combustion engine.

In starting a miniature internal combustion engine a source of electrical current must be temporarily connected to the glow plug of the engine. After the engine has been started and is running, however, the electrical connection is removed and the heat of the running engine alone is sufficient to maintain the glow plug at operating temperature.

The method most commonly used to connect a miniature engine to a current source is to connect the two terminals of a battery to a clip and then to attach this clip to the engine prior to startup. Clips currently in use (such as that disclosed in U.S. Pat. No. 2,928,067 suffer from a number of practical disadvantages which make their use in some cases both dangerous and inefficient.

First among these disadvantages are problems of elelctrical reliability. Clips of the type disclosed in U.S. Pat. No. 2,928,067, for example, consist of two pivoting contacts; one contact contains a depression which bears on the tip of the glow plug of the engine, while the other contains a flange designed to engage a protruding surface of the engine. The contact which contains the depression presents a relatively small area for electrical contact between it and the tip of the glow plug. Even more significantly, however, the depression itself creates an ideal area for oxidation and the accumulation of dirt and other foreign materials, both of which sharply reduce the effectiveness and reliability fo the electrical contact after prolonged use of the clip.

In addition, such pivoting contact type connector clips can present safety problems if not used properly or after prolonged periods of use. During startup the miniature engine generally vibrates severly. In such instances, the glow plug tip can vibrate out of the shallow depression formed in the clip. This allows the clip to slip off of the engine and possibly to fall into the spinning propeller with consequent injury to the operator and damage to the engine.

Finally, such connector clips are commonly constucted with springs which weaken after prolonged use. The purpose of the spring is to provide a holding force securing the connector clip to the miniature engine. When a spring weakens after prolonged use the holding force is reduced, and the connector clip is less securely held to the engine. Electrical reliability problems are made more severe because of reduced contact pressure, and the clip is more likely to vibrate off the engine during startup.

The connector clip which is the subject of the present invention is an improved clip which is not subject ot the above-mentioned disadvantages of commonly used prior art connector clips. The connector clip of this invention comprises two conducting strips of metal separated by an insulator body. One conductor engages the engine, the other engages the insulated tip of the glow plug of the engine in a recess formed in the conductor. The two conductors are positioned substantially parallel to one another, and the contacting surfaces of the two conductors are firmly held to the engine itself by means of a spring. This spring forces one conductor to slide parallel to the other, thereby clamping the engine between the contacting surfaces of the two conductors.

Since the connector clip of the present invention employs a recessed contact which surrounds and fits over the top of the glow plug tip, it not only provides greater electrical contact area, but it has a tendency to clean itself after each use, and thus, to minimize the accumulation of dirt and oxidation on the contact. In this way, both the electrical reliability and the performance characteristics of the connector clip of the present invention are improved. Moreover, the recessed contact is designed to lock against the tip of the glow plug, which in conbination with the parallel forces exterted by the spring, significantly reduces the chances of the clip accidently vibrating off the engine during startup. In this way, the safety characteristics of the connector clip of the present invention are also improved.

BRIEF DESCRIPTION OF THE DRAWINGS

The present invention will be better understood by reference to the drawings, which illustrate one embodiment of the improved connector clip described herein.

FIG. 4 is a sectional view taken along line 4—4 of FIG. 3 showing internal construction of the connector clip of the present invention.

FIG. 5 is an exploded perspective view of the connector clip of the present invention.

DETAILED DESCRIPTION OF THE INVENTION

Figure 1:
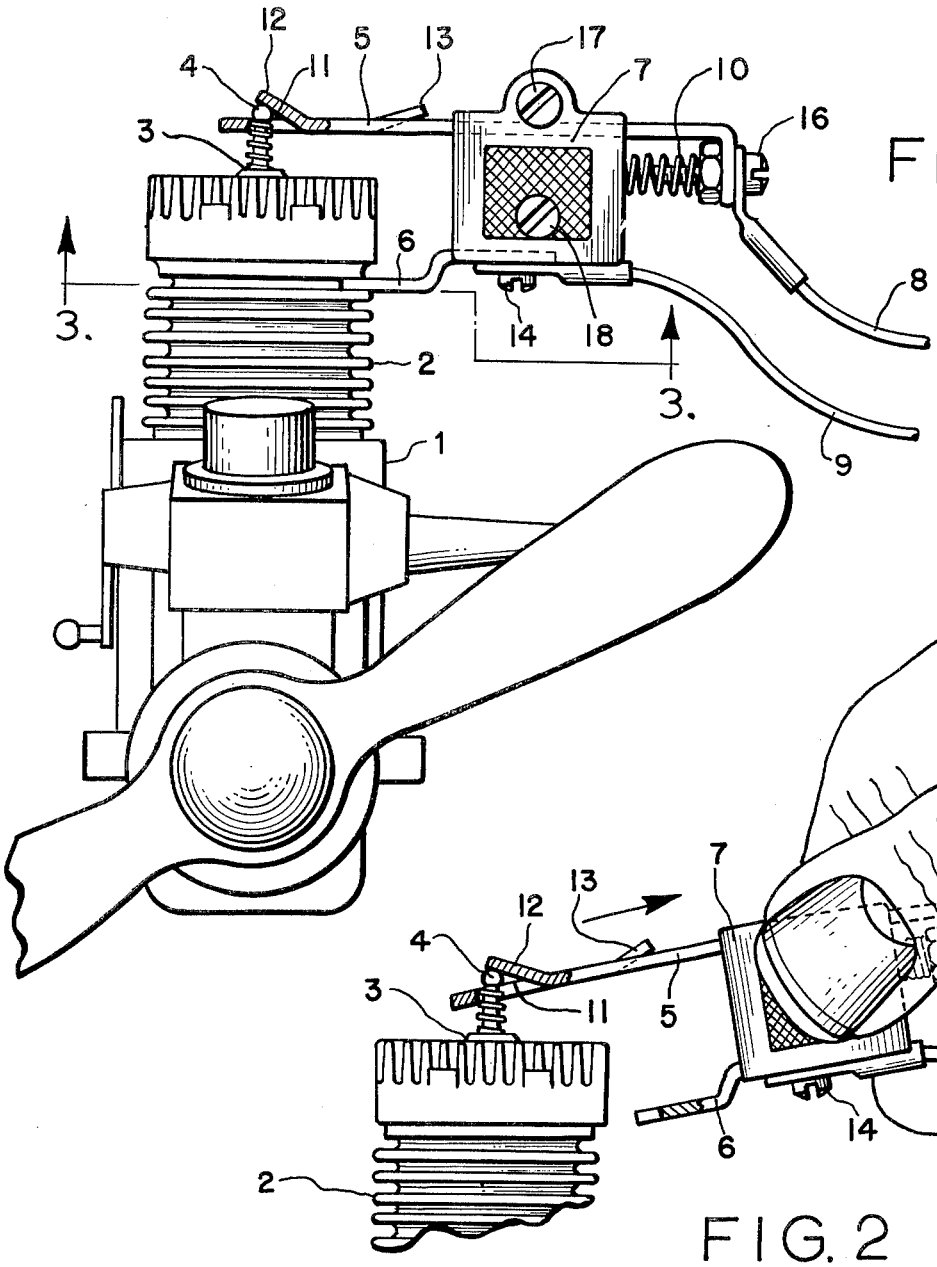
FIG. 1 is a front view of a miniature engine and one embodiment of the connector clip of the present invention in an applied position ready for startup.

Referring now more specifically to the drawings, FIG. 1 shows a miniature internal combustion engine, designated 1, with cooling fins 2 around the periphery of the engine, glow plug 3 and an insulated glow plug tip 4 at the top of the engine. The connector clip of the present invention comprises a glow plug conductor 5 and an engine conductor 6 which are electrically separated by an insulator body 7, which holds conductive elements 5 and 6 in an assembled relationship. Insulator body 7 is formed from two pieces of an insulating plastic such as nylon which are held together by fastening means 17 and 18. Conductors 5 and 6 are connected by means of wires 8 and 9 to the terminals of a battery (not shown). Conductors 5 and 6 are formed from strips of an electrically conductive metal. Conductor 6 is rigidly fixed to insulator body 7 by fastening means 14, which also serves to attach wire 9 to conductor 6. As shown in FIG. 5, conductor 5 is mounted in an opening in insulator body 7 which allows conductor 5 to slide along a line parallel to conductor 6. Spring 10 is mounted between insulator body 7 and conductor 5. Spring 10 is biased against insulator body 7 and secures conductors 5 and 6 to the engine by forcing recess 11 conductor 5 to slide toward insulator body 7. The length and stiffness of spring 10 are chosen to provide sufficient clamping forces so that the connector clip is not easily removed by vibration yet may easily be compressed by the operator during installation. As shown in FIGS. 4 and 5, spring 10 is held in assembled position by fastening means 16 and recess 15 which is formed in insulator body 7. Fastening means 16 also serves to secure wire 8 to conductor 5.

As shown in FIG. 5, flange element 12 is cut out of conductor 5 and is spaced from and extends upwardly over recess 11; the flange 12 serves to prevent conductor 5 from slipping over insulated glow plug tip 4 and coming into contact with the engine frame. Flange element 13 is also cut out of conductor 5 and is raised above conductor 5 to provide a mechanical stop to the sliding motion of conductor 5.

Figure 3:
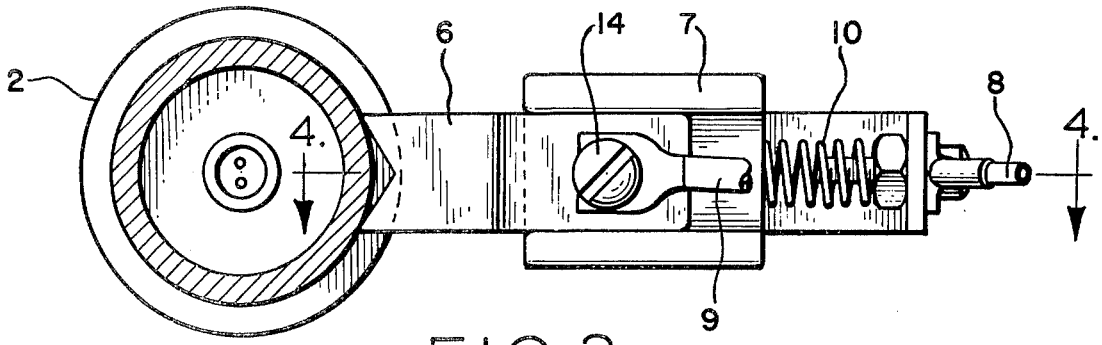
FIG. 3 is a sectional view taken along line 3—3 of FIG. 1 showing the type of connection which is made between cooling fins of the engine and one contact of the connector clip of the present invention.

FIG. 3 shows how the contacting end of conductor 6 may be configured so as to be self centering on the cylindrical surface between adjacent cooling fins 2. Such a configuration provides secure two point contact between the conductor and the engine and it prevents conductor 5 from slipping off the engine.

Figure 2:
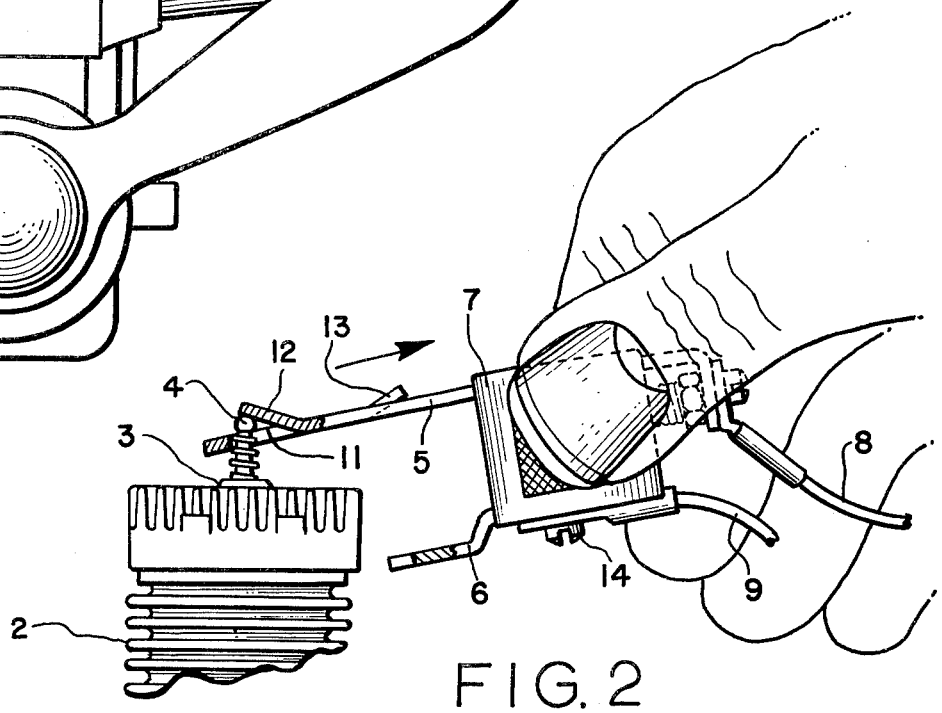
FIG. 2 is a front view of the connector clip being applied to the engine.

FIG. 2 shows a desired method of installing the connector clip to the engine. The operator grasps the engine in one hand and insulator body 7 in the other and positions recess 11 of conductor 5 over the insulated glow plug tip 4. He then pulls back on insulator 7, compressing spring 10, until conductor 6 can be positioned between two adjacent cooling fins. The insulator is then released, and spring 10 securely clamps the connector clip to the engine. After the engine has been started the clip is removed by reversing the procedure.

From this description it will be seen that the conductor clip of the present invention is designed for ease of manufacture and for rapid, releasable attachment to a miniature internal combustion engine. The connector clip disclosed herein utilizes a recess in the glow plug conductor which provides improved electrical reliability; the contact area between the glow plug tip and the conductor is larger than in present connector clips. Furthermore, the contact recess is actually self cleaning in that the conductor is scraped across the glow plug with every installation of the starter clip and accumulated dirt and oxidation are continually removed. This connector clip also provides improved safety of operation. The glow plug conductor encircles the tip of the glow plug and locks to the glow plug tip with a positive clamping force which reduces the possibility that the connector clip will vibrate loose during engine startup. This clamping force is provided by a type of spring which is superior to the spring clip used in the prior art in that it is characterized by a longer useful life.

Of course, it should be understood that various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. A connector clip for releasably attaching a source of electrical current to the glow plug of a miniature internal combustion engine comprising:

a first slidably disposed conductive means for receiving the insulated tip of the glow plug of said engine, having means associated therewith to limit the sliding motion thereof;

a second conductive means for engaging said engine, and adapted for insertion between adjacent cooling fins thereof;

an insulator body separating the first and second conductive means; and means for applying force to cause one of said conductive means to move in a substantially parallel direction relative to the other of said conductive means, thereby securing said connector clip to said engine.

2. The connector clip described in claim 1 wherein said limiting means comprises a projecting element adapted to abut said insulator body to limit the sliding motion of said conductive strip.

3. The connector clip described in claim 1 wherein said first conductive means comprises a conductive strip having a recess formed in one end adapted to receive the insulated tip of the glow plug of the engine.

4. The connector clip described in claim 3 wherein said conductive strip includes means for preventing said conductive strip from contacting said engine when the connector clip is applied to said engine with the insulated glow plug tip received in said recess of said conductive strip.

5. The connector clip described in claim 4 wherein said means for preventing said conductive strip from contacting said engine comprises a flange of said conductive strip spaced from and extending above said recess.

6. The connector clip described in claim 5 wherein said first conductive means comprises a conductive strip mounted so as to slide through an opening formed in said insulator body and said means for applying force comprises a spring and said conductive means is adapted for insertion between adjacent cooling fins of said engine.

7. The connector clip described in claim 1 wherein said means for applying force comprises a spring.

8. The connector clip described in claim 7 wherein said insulator body is formed with an opening to accommodate said spring.

9. In a connector clip for releasably attaching a source of electrical current to the glow plug of a miniature internal combustion engine, said connector clip comprising a first conductive means for providing electrical contact with the insulated glow plug tip of said engine, a second conductive means for providing electrical contact with said engine, and an insulator body separating said first and second conductive means, the improvement comprising:

said first conductive means comprising a conductive strip mounted in a substantially parallel slidable relationship with said second conductive means, and having a recess formed therein to receive the insulated tip of said glow plug;

said second conductive means being adapted for insertion between adjacent cooling fins of said engine; and means for applying force to said first conductive means sufficient to move it in a substantially parallel direction relative to said second conductive means, thereby securing said connector clip to said engine.

10. The connector clip of claim 9 wherein said first connector means has means associated therewith to limit the sliding motion of said first connector means.

11. The connector clip of claim 9 wherein said means for applying force to said first conductive means is a spring mounted on said insulator body.

* * * * *